US006683303B2

(12) United States Patent
Yoshinari et al.

(10) Patent No.: US 6,683,303 B2
(45) Date of Patent: Jan. 27, 2004

(54) ION TRAP MASS SPECTROMETER AND SPECTROMETRY

(75) Inventors: Kiyomi Yoshinari, Hitachi (JP); Yoshiaki Kato, Mito (JP); Tadao Mimura, Hitachinaka (JP); Shinji Nagai, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/087,743

(22) Filed: Mar. 5, 2002

(65) Prior Publication Data

US 2002/0162958 A1 Nov. 7, 2002

(30) Foreign Application Priority Data

Apr. 17, 2001 (JP) ..... 2001-118158

(51) Int. Cl.[7] ..... H01J 49/42
(52) U.S. Cl. ..... 250/292; 250/282
(58) Field of Search ..... 250/281–282, 250/291–293

(56) References Cited

U.S. PATENT DOCUMENTS 6,124,591 A 9/2000 Schwartz et al.

2002/0008199 A1 * 1/2002 Yoshinari et al. ..... 250/298

FOREIGN PATENT DOCUMENTS

JP 9-5298 1/1997

* cited by examiner

*Primary Examiner*—John R. Lee
*Assistant Examiner*—Christopher M. Kalivoda
(74) *Attorney, Agent, or Firm*—Dickstein Shapiro Morin & Oshinsky LLP

(57) ABSTRACT

An ion trap mass spectrometer and spectrometry capable of dissociating ions to be dissociated efficiently regardless of ionic species without useless time and performing high-sensitive MS/MS spectrometry, lengthens a period for applying a CID voltage in accordance with a mass number or characteristics of ions to be dissociated in proportion to a mass-to-charge ratio of ions to be dissociated to thereby optimize the application period of the supplementary AC voltage applied in superposition manner in order to dissociate specific ionic species, so that ions to be dissociated are dissociated efficiently and high-sensitive analysis of dissociated ions can be attained without useless time.

15 Claims, 11 Drawing Sheets

ION TRAP MASS SPECTROMETER AND SPECTROMETRY

BACKGROUND OF THE INVENTION

The present invention relates to an improvement of an ion trap mass spectrometer and spectrometry in which certain specific ionic species are captured stably and then a supplementary AC electric field is generated so that the specific ionic species are excited resonantly to thereby dissociate the specific ionic species so that the dissociated ions generated at this time are subjected to the tandem mass spectrometry (MS/MS).

The ion trap mass spectrometer includes ion trap electrodes as disclosed in JP-A-9-5298. In the ion trap mass spectrometer, all of ionic species having a mass-to-charge ratio (m/Z) within a certain range are once captured stably and ions are oscillated at different frequencies in accordance with the mass-to-charge ratio thereof. This oscillation is utilized to superpose a supplementary AC electric field having a specific frequency upon a space between ion trap electrodes so that ions resonating with the supplementary AC electric field are ejected from the space to separate mass thereof. The mass spectrometry includes a method in which the mass number of substance in a sample is analyzed and a tandem mass spectrometry (MS/MS) in which ions having a certain specific mass number are dissociated as disclosed in the above publication and the dissociated ions generated at this time are subjected to the mass spectrometry. In the latter method, the supplementary AC electric field for exciting the oscillating motion of ions having the certain specific mass number resonantly is applied to the space between the ion trap electrodes in superposition manner thereupon to collide with neutral gas existing in the space to thereby dissociate the specific ionic species. In order to generate the supplementary AC electric field, a supplementary AC voltage, that is, CID (collision-induced dissociation) voltage is applied across the ion trap electrodes. The dissociated ions generated in this manner are subjected to successive scanning and analysis processing for mass separation, so that more detailed information concerning the molecular structure of the specific ions can be obtained. Accordingly, the MS/MS mass spectrometric function is one of the most important functions of the mass spectrometer in recent years.

U.S. Pat. No. 6,124,591 discloses an application method of the CID voltage in which an amplitude of the CID voltage is increased in proportion to the mass number of parent ions to be dissociated and its application time is uniformly set to be 30 ms.

The ion trap mass spectrometer includes, as shown in FIG. 2, a ring electrode 10 and two end cap electrodes 11 and 12 disposed opposite to each other so that the ring electrode is disposed between the two end cap electrodes. The ring electrode 10 and the end caps 11 and 12 are hereinafter named ion trap electrodes generically. A DC voltage U and a radio-frequency voltage V cos ωt are applied across the respective electrodes to form a quadrupole electric field in the space between the electrodes. The stability of the orbit of ions captured in the field is determined by the following equation in accordance with a and q values given by a size of the apparatus (an inner diameter $r_0$ of the ring electrode), the DC voltage U and an amplitude V and an angular frequency Ω of the radio-frequency voltage applied to the electrodes and a mass-to-charge ratio m/Z.

$$a = \frac{8eU}{\gamma_0^2\Omega^2}\cdot\frac{Z}{m} \quad q = \frac{4eV}{\gamma_0^2\Omega^2}\cdot\frac{Z}{m} \tag{1}$$

where Z represents ion valency number, m represent mass and e represents elementary charge. FIG. 3 is a diagram showing a stable area of the values a and q for determining a stable orbit in the space between the ion trap electrodes. Generally, since only radio-frequency voltage V cos Ωt (RF drive voltage) is applied to the ring electrode, all of ions positioned on the straight line of a=0 in the stable area oscillate in the space between the electrodes stably and are captured between the electrodes. At this time, the ions are arranged at different points (0, q) in the stable area shown in FIG. 3 in accordance with the mass-to-charge ratio thereof and disposed at positions from q=0 to q=0.908 on the a-axis in descending order of the mass-to-charge ratio on the basis of the above equation. Accordingly, in the ion trap mass spectrometer, all of ionic species having the mass-to-charge ratio (m/Z) within a certain range are once captured stably and at this time the ions oscillate at different frequencies in accordance with the mass-to-charge ratio (m/Z) thereof. This principle can be utilized to superpose a supplementary AC electric field having a certain specific frequency upon the space between the ion trap electrodes, so that ions resonating with the supplementary AC electric field are ejected from the space between ion trap electrodes to separate mass thereof. In the case of the tandem mass spectrometry (MS/MS), the supplementary AC electric field for exciting the oscillating motion of ions having a certain specific mass number resonantly is applied to the space between the ion trap electrodes in superposition manner thereupon to collide with neutral gas existing in the space to thereby dissociate the specific ionic species. However, the supplementary AC voltage, that is, CID voltage applied across the ion trap electrodes in order to generate the supplementary AC electric field is set to a magnitude of the degree that parent ions having a certain specific mass number are not ejected from the space between the ion trap electrodes. The dissociated ions generated in this manner are subjected to successive scanning (mass analysis scanning) for mass separation to analyze the dissociated ionic species. In order to analyze the dissociated ions with high sensitivity, high-efficient dissociation of parent ions is required.

In the above-mentioned U.S. Pat. No. 6,124,591, the amplitude of the CID voltage is increased in proportion to the mass number of parent ions to be dissociated, while its application time is uniformly set to 30 ms. Generally, ions having the high mass number or ions having very stable structure are difficult to dissociate by the collision-induced dissociation (CID). Accordingly, the ions having the higher mass number or ions having the stable structure have low dissociation efficiency, so that the result of the MS/MS spectrometry has low sensitivity. Alternatively, it is necessary to repeat a lot of spectrometry operations until a desired sensitivity is attained and the total spectrometric time is made long.

SUMMARY OF THE INVENTION

It is an object of the present invention to provide an ion trap mass spectrometer and spectrometry or spectrometric method capable of performing MS/MS spectrometry in a relatively short time with high sensitivity.

According to the present invention, a time for applying the CID voltage is adjusted in accordance with, for example, the mass number or characteristics of parent ions to be dissociated.

Thus, there can be provided the ion trap mass spectrometer and spectrometry capable of optimizing a time for applying the CID voltage in accordance with the mass number or characteristics of parent ions to be dissociated and performing MS/MS spectrometry with desired sensitivity without useless time.

Other objects, features and advantages of the invention will become apparent from the following description of the embodiments of the invention taken in conjunction with the accompanying drawings.

DESCRIPTION OF THE INVENTION

Embodiments of the present invention will be described with reference to the accompanying drawings.

Figure 1:
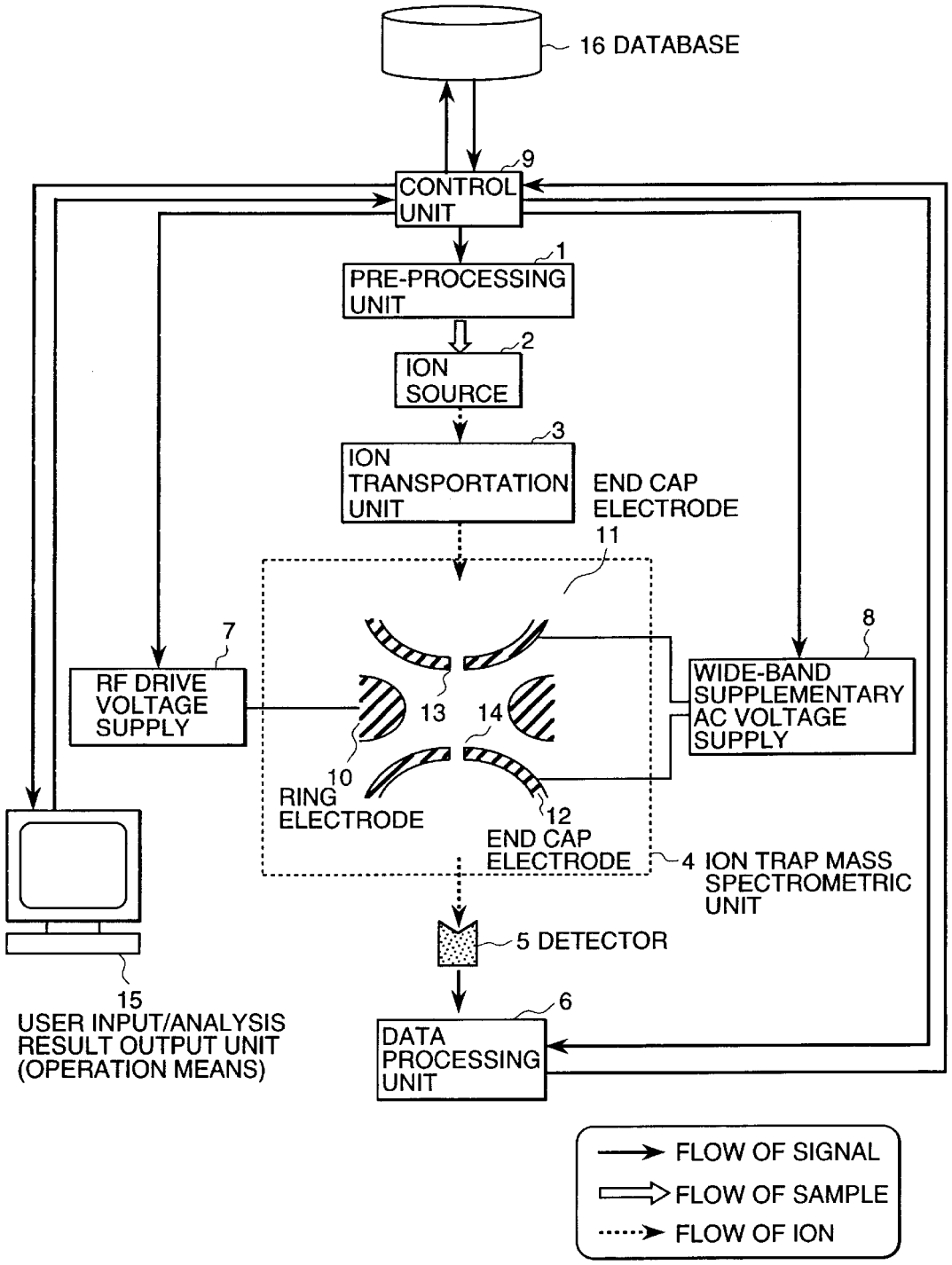
FIG. 1 is a schematic diagram illustrating the whole of an ion trap mass spectrometer according to a first embodiment of the present invention.
Figure 2:
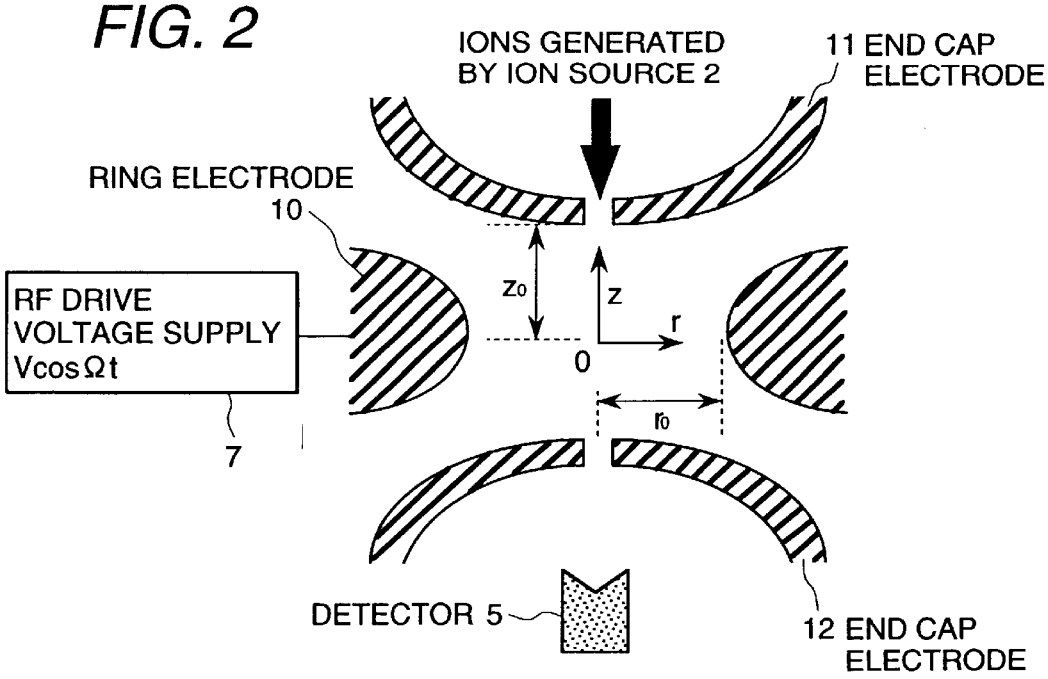
FIG. 2 is a sectional view showing electrodes for an ion trap.
Figure 3:
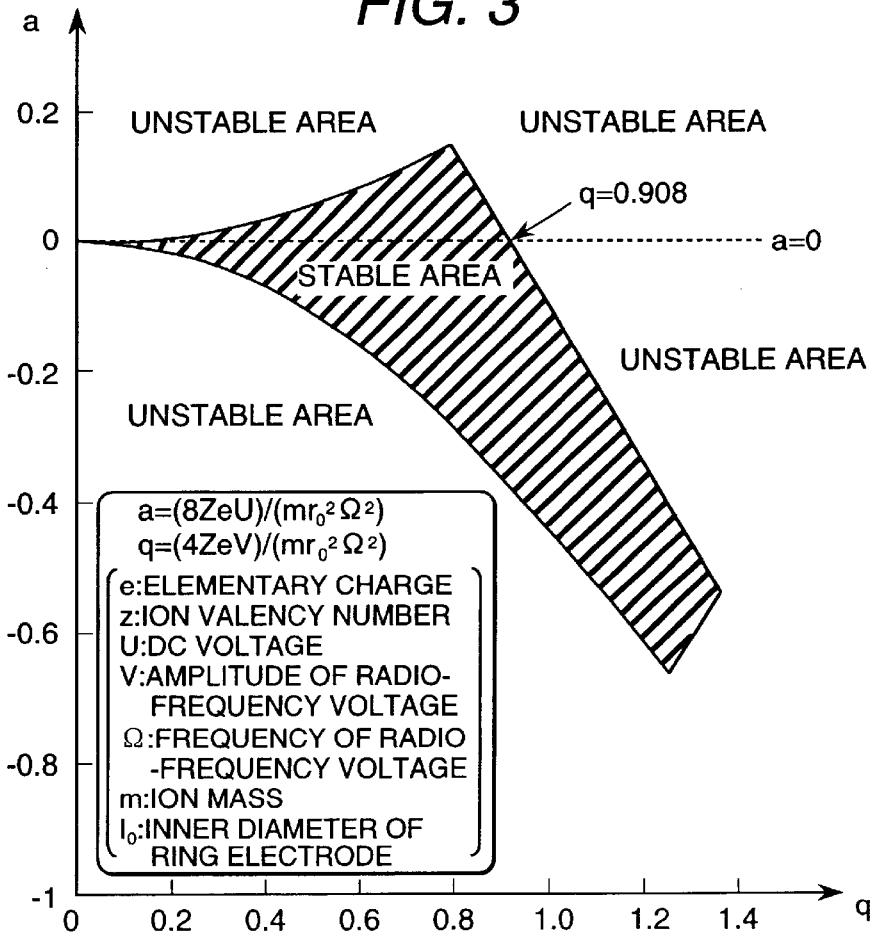
FIG. 3 is a diagram showing a stable area of values a and q for determining the stability of an orbit of ions in an ion trap.

A first embodiment is now described. FIG. 1 is a schematic diagram illustrating the whole of an ion trap mass spectrometer according to a first embodiment of the present invention. A mixture sample to be subjected to mass spectrometry passes through a pre-processing system 1 such as gas chromatographic or liquid chromatographic apparatus in which components thereof are separated and is ionized in an ion source 2. An ion trap mass spectrometric unit 4 includes a ring electrode 10 and two end cap electrodes 11 and 12 disposed opposite to each other so that the ring electrode 10 is disposed between the two end cap electrodes. A quadrupole electric field is generated in the space between electrodes by an RF drive voltage VRFcos Ωt supplied to the ring electrode 10 from an RF drive voltage supply 7. Ions produced by the ion source 2 pass through an ion transportation unit 3 and enter or are injected between the ring electrode 10 and the end cap electrodes 11 and 12 (the inter-electrode space) front an inlet 13 of the end cap electrode 11. The ions are once trapped in the space by the quadrupole electric field stably and the ions having different mass-to-charge ratio are then subjected to successive mass separation (mass scanning analysis). In the tandem mass spectrometry (MS/MS), unnecessary ions except ions (parent ions) having a certain specific mass number are ejected from the inter-electrode space and a supplementary AC electric field (CID supplementary electric field) for resonantly exciting the oscillation motion of ions having the specific mass number and left in the inter-electrode space is applied to the space between the ion trap electrodes in superposition manner thereupon to thereby collide with neutral gas existing in the space, so that parent ions are dissociated and the dissociated ions (daughter ions) produced at this time are subjected to mass spectrometry successively. The mass separation method is broadly divided into two methods. In one method, the RF drive voltage VRFcos Ωt supplied to the ring electrode 10 from the RF drive voltage supply 7 is adjusted to thereby unstabilize the orbit of the specific ionic species among the ionic species to be subjected to mass spectrometry so that the specific ionic species are ejected from the inter-electrode space. In the other method, the specific ionic species are resonantly excited by a supplementary AC electric field generated by applying a supplementary AC voltage having a single frequency from a supplementary AC voltage supply 8 across the end cap electrodes 11 and 12 so that the specific ionic species are ejected from the space between the ion trap electrodes and are subjected to mass separation. The ions subjected to mass separation by means of the methods are ejected from the inter-electrode space in accordance with the mass-to-charge ratio. Generally, since the supplementary AC voltage having a fixed frequency is applied, an amplitude VRF of the RF drive voltage VRFcosΩt is scanned on the basis of the relation of the above equation to thereby sweep the mass-to-charge ratio of the ions to be subjected to mass separation successively. Ions passing through an outlet 14 of the end cap electrode 12, of ions ejected from the inter-electrode space are detected by a detector 5 and processed by a data processing unit 6. The series of mass spectrometric processes including ionization of the sample, transportation and injection of the sample ion beam into the ion trap mass spectrometric unit, adjustment of the RF drive voltage amplitude upon injection of sample ions, ejecting of unnecessary ions from the space between the ion trap electrodes, dissociation of parent ions, sweep of the RF drive voltage amplitude (sweep of the mass-to-charge ratio of ions to be subjected to mass spectrometry), adjustment of amplitude, kind and timing of the supplementary AC voltage, detection and data processing is controlled by a control unit 9.

Figure 4A:
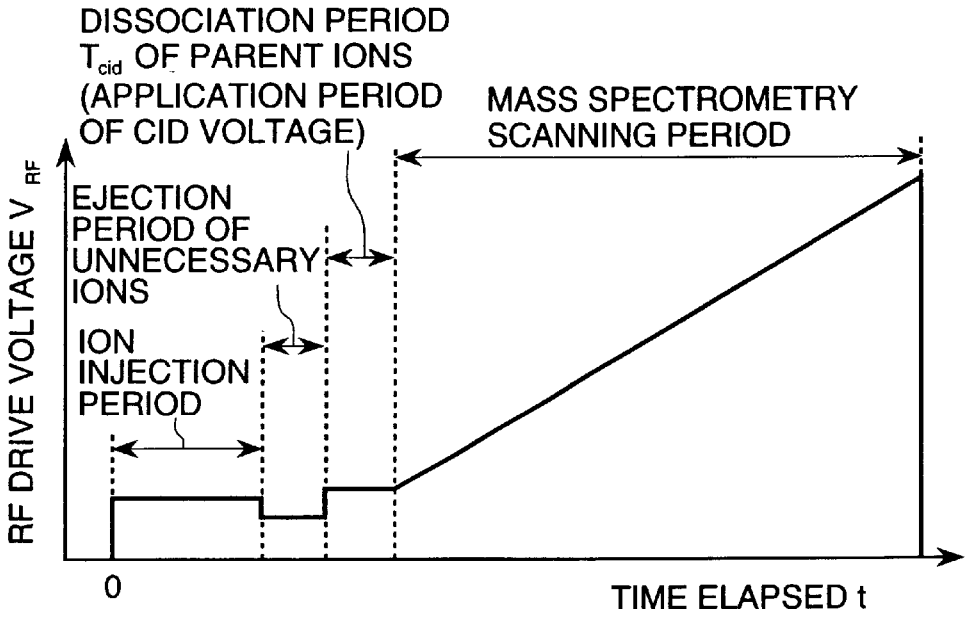
FIGS. 4A and 4B show basic sequences of two examples in a tandem mass spectrometry process according to the present invention.

When the specific ionic species in the sample are subjected to the tandem mass spectrometry, ions except the specific ionic species are generally ejected from the space between the ion trap electrodes. At this time, since the ions captured in the space are oscillated at different oscillation frequencies in accordance with the mass-to-charge ratio thereof, a wide-band supplementary AC voltage within the range of oscillation frequencies corresponding to the range of the mass-to-charge ratio of unnecessary ions is applied across the end cap electrodes 11 and 12 to generate a wide-band supplementary AC electric field so that the unnecessary ions are ejected resonantly. The supplementary AC voltage (CID voltage) $V_{cid}$ cos (2πft) having the same frequency $f=f_p(=\omega_p/2\pi)$ as the natural oscillation frequency of parent ions left in the space or the frequency $f-f_p$ near thereto is applied across the end cap electrodes 11 and 12 from the supplementary AC voltage supply 8 to amplify the oscillating motion of parent ions so that the parent ions are caused to collide with neutral gas existing in the space to thereby dissociate the parent ions. However, the CID voltage is set to a magnitude of the degree that the parent ions are not ejected from the space between the ion trap electrodes. FIG. 4A is a sequence diagram showing the tandem mass spectrometric process in the embodiment. The wide-band supplementary AC voltage is applied during the ejection period of unnecessary ions after the injection period of the sample ions into the space between the ion trap electrodes to eject unnecessary ions and the CID voltage is applied during the dissociation period of the parent ions to dissociate the parent ions. As shown in FIG. 4A, the amplitude value $V_{RF}$ of the RF drive voltage $V_{RF}$ cos Ωt applied to the ring electrode may be set to be different during respective periods including the ion injection period, the ejection period of unnecessary ions and the dissociation period of parent ions.

Figure 5A:
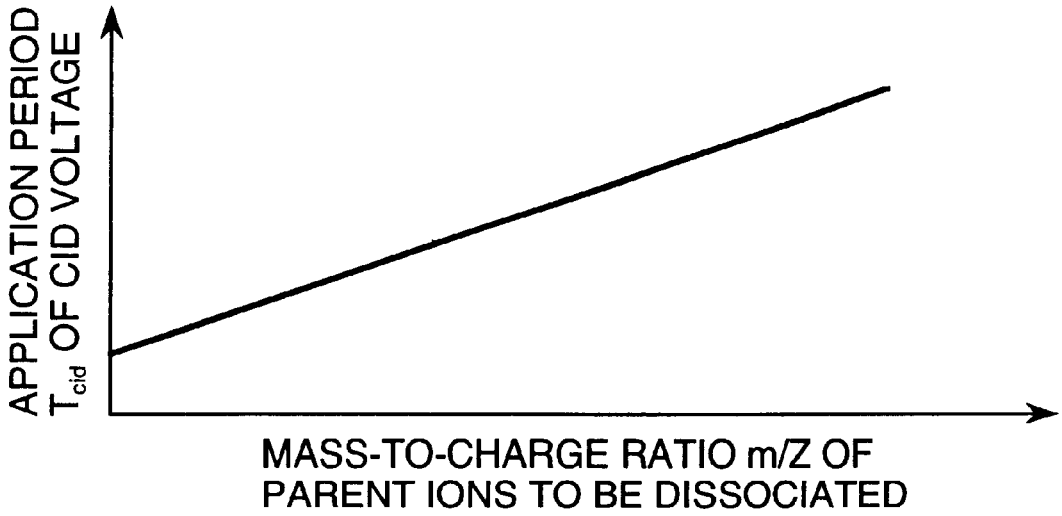
FIGS. 5A and 5B illustrate a method of setting an application time and an amplitude of the CID voltage in the first embodiment of the present invention.
Figure 5B:
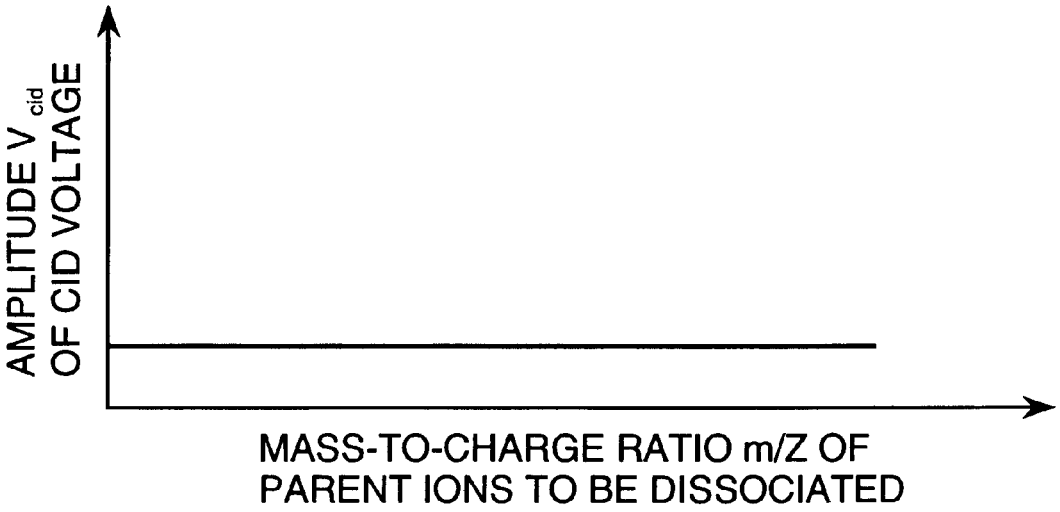

Referring now to FIGS. 5A–8, the method of applying the CID voltage across the ion trap electrodes in order to dissociate the parent ions by collision of the parent ions with neutral gas according to the embodiment is described. In the embodiment, the application period $T_{cid}$ of the CID voltage is set to be increased in proportion to the mass-to-charge ratio m/Z of the parent ions to be dissociated as shown in FIG. 5A. First, as shown in FIGS. 1 and 6A, the control unit 9 controls the total system of the mass spectrometer so that ions except the parent ions to be dissociated are ejected from the ion trap space as unnecessary ions on the basis of the mass-to-charge ratio m/Z of the parent ions to be dissociated inputted by a user input/analysis data result output unit (operation means) 15 and then decides the period $T_{cid}$ for applying the ion CID voltage in accordance with the mass-to-charge ratio m/Z on the basis of the relation equation of FIG. 5A to set it. At this time, the mass-to-charge ratio m/Z of the parent ions to be dissociated may be automatically calculated such that ions having the strongest signal obtained by pre-scanning performed prior to the tandem mass spectrometry are automatically selected as parent ions as shown in FIG. 6B. Further, the amplitude $V_{cid}$ of the CID voltage $V_{cid}$ cos (2πft) may be fixed irrespective of the mass-to-charge ratio m/Z of the parent ions to be dissociated as shown in FIG. 5B. However, the amplitude of the CID voltage is set to a magnitude of the degree that the parent ions resonantly excited by the CID supplementary AC electric field produced in the space between the ion trap electrodes in response to application of the CID voltage $V_{cid}$ cos(2πft) are not ejected from the space between the ion trap electrodes.

Figure 7:
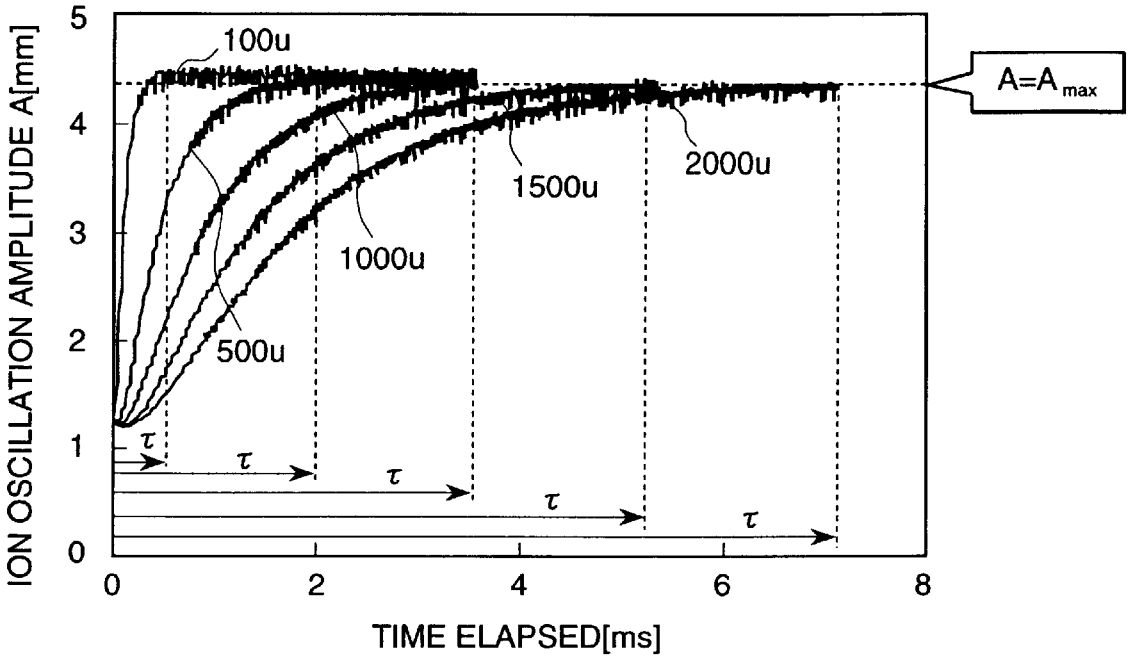
FIG. 7 is a graph showing a result of numerically analyzing a maximum oscillating amplitude value A of ions.
Figure 8:
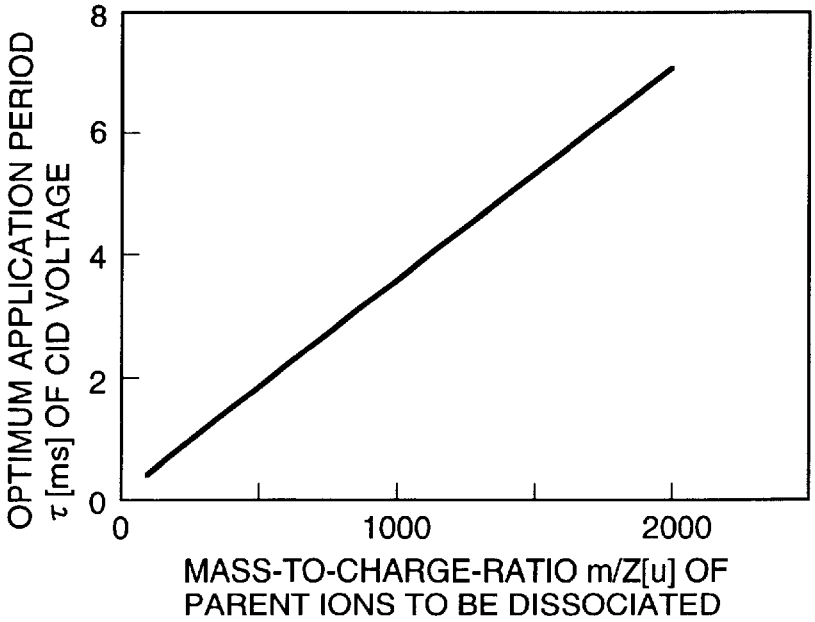
FIG. 8 is a graph showing a relation of a mass-to-charge ratio of parent ions to be dissociated and a maximum oscillating amplitude value.

Referring now to FIGS. 7 and 8, the effects of the embodiment are described. FIG. 7 shows results calculated by numerical analysis of oscillation amplitudes of ions versus elapsed time for 100, 500, 1000, 1500 and 2000 u of parent ions to be dissociated when the CID voltage $V_{cid}$ cos(2πft) having amplitude $V_{cid}$=0.5 V and frequency f=73.92 kHz is applied across the end cap electrodes 11 and 12. The oscillation amplitudes of the respective ionic species are increased gradually and when the amplitudes reach a fixed value, the amplitudes are not increased any more and are maintained around the fixed value. It is considered that the reason is that the force acting in the direction of resonance amplification by the CID supplementary AC electric field generated by the CID voltage balances with a resistant force by neutral gas (in this case He gas) in the space between the ion trap electrodes. The time τ taken until the maximum fixed amplitude $A=A_{max}$ is reached is largely different depending on the mass number m (mass-to-charge radio m/Z) of the parent ions. FIG. 7 shows a graph obtained by plotting the time T for the respective ionic species taken until the fixed amplitude $A=A_{max}$ is reached in accordance with the mass number. It is understood that the time τ is increased in proportion to the mass number m of the parent ions. In this connection, it is considered that as the ion oscillation amplitude A is larger, the oscillation energy is increased and the dissociation efficiency is improved. That is, it is considered that the parent ions are oscillated at the maximum amplitude $A=A_{max}$ to thereby dissociate ions with maximum efficiency.

When the application period $T_{cid}$ of the CID voltage is set to a fixed value, for example, $T_{cid}$=2 ms, irrespective of the mass number of the parent ions to be dissociated, the oscillation amplitude A of ions having the high mass number exceeding m=1000 u is smaller than the maximum amplitude $A_{max}$ ($A<A_{max}$) and the dissociation efficiency is reduced as compared with the case where the mass number of the parent ions is low since the maximum amplitude is not reached. In the embodiment, the application period $T_{cid}$ of the CID voltage is adjusted and set in accordance with the mass-to-charge ratio m/Z of the parent ions (mass number m for monovalent ions(Z=1)) on the basis of the relation of FIG. 8, so that the parent ions can be always dissociated with high efficiency regardless of the mass number of the parent ions and the dissociated ions (daughter ions) can be analyzed with high sensitivity. The setting thereof can be made by means of the user input/analysis result output unit (operation means) 15. The operation means constitutes means for causing the user to input information concerning ionic species to be dissociated, mass-to-charge ratio of ions to be dissociated or dissociation energy (energy necessary for dissociating ions) and the control unit 9 includes means for changing over the application period of the supplementary AC electric field having the specific frequency on the basis of the inputted information. It is a matter of course that the application period of the supplementary AC electric field having the specific frequency may be directly inputted by means of the operation means 15.

In the embodiment, the ion trap mass spectrometer including the ring electrode 10, the two end cap electrodes 11 and 12 disposed opposite to each other so that the ring electrode 10 is disposed between the end cap electrodes, the radio-frequency power supply 7 for producing the high-frequency voltage $V_{RF}$ cos Ωt supplied between the ring electrode 10 and the end cap electrodes 11 and 12, the ion source 2 for generating ions, means 7, 9 to 12 for capturing the generated ions in the inter-electrode space in which the high-frequency electric field is generated, means 8 for generating the supplementary AC electric field (CID voltage: $V_{cid}$ cos(2πft)) having the certain specific frequency f, and means 5 for detecting ions ejected from the inter-electrode space, comprises the operation means 15 for causing the user to input the application period $T_{cid}$ of the supplementary AC electric field having the specific frequency applied to resonantly excite ions having the specific mass-to-charge ratio and setting it. Further, the operation means 15 includes means for causing the user to input information concerning the ionic species to be dissociated and the mass-to-charge ratio or dissociation energy of ions to be dissociated, and the ion trap mass spectrometer further includes means 9 and 8 for changing over the application period of the supplementary AC electric field on the basis of the information inputted by the user.

Figure 9A:
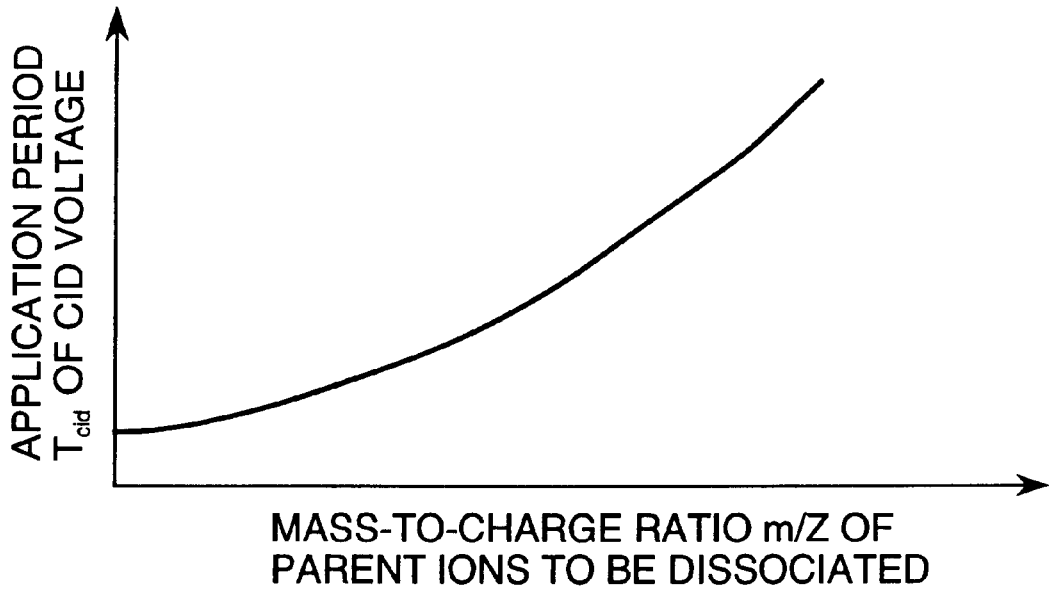
FIGS. 9A and 9B illustrate setting methods of an application time of the CID voltage in a second embodiment of the present invention.
Figure 9B:
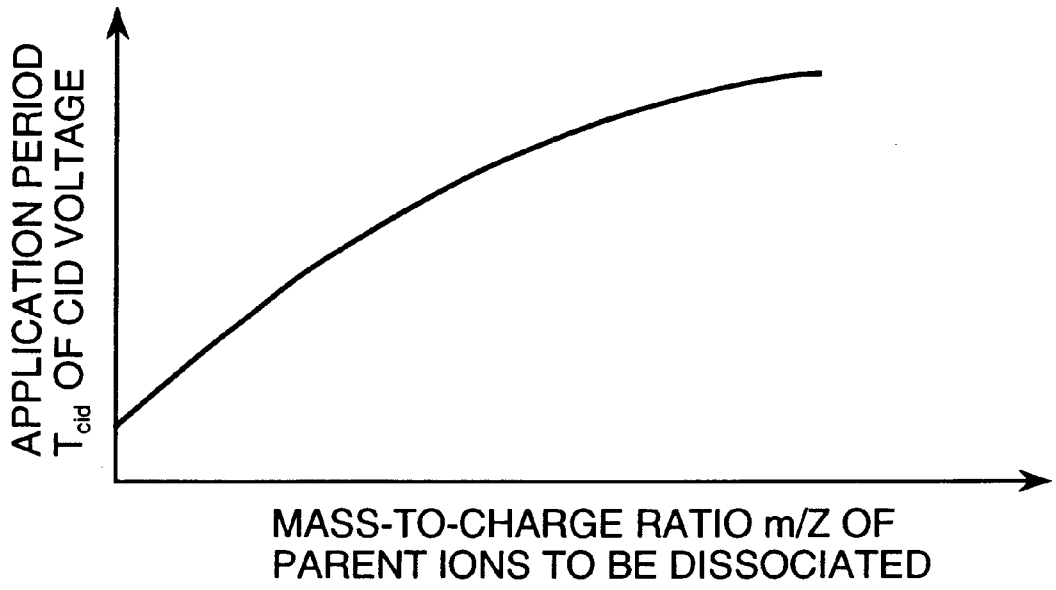

Referring now to FIGS. 9A and 9B, a second embodiment of the present invention is described. In this embodiment, when the application period $T_{cid}$ of the CID voltage is changed to be set in accordance with the mass number m (or mass-to-charge ratio m/Z) of the parent ions to be dissociated, the application period $T_{cid}$ of the CID voltage is changed on the basis of the relation that a change rate (differential form) $d^2(T_{cid})/dm^2$ of $T_{cid}$ to m is larger than 0 ($d^2(T_{cid})/dm^2>0$) as shown in FIG. 9A. When the sample contains substance having the stable structure as the mass number is larger, there is the possibility that the dissociation efficiency is not increased only by proportionating the application period of CID voltage to the mass number. For example, ion species having the benzene ring structure have the stable structure and accordingly it is difficult to dissociate. In such case, there is the possibility that the application period of the CID voltage is insufficient and accordingly when the application period of the CID voltage is increased for the ions having the large mass number on the basis of the relation as shown in FIG. 9A, it is considered that the dissociation efficiency is improved. Further, when the specimen contains a substance whose structure becomes unstable as the mass number is larger, there is the possibility that the CID voltage is applied excessively over the necessary period and the analysis time is wasted in vain according to the relation as shown in FIG. 5A. In such case, as shown in FIG. 9B, when the application period $T_{cid}$ of the CID voltage is changed on the basis of the relation that the change rate (differential form) $d^2(T_{cid})/dm^2$ of $T_{cid}$ to m is smaller than 0 ($d^2(T_{cid})/dm^2>0$), a minimum application period of the CID voltage that the high-efficient dissociation can be obtained is set and accordingly it can be expected that the time for the high-sensitive analysis can be reduced. Thus, according to the embodiment, since the application period of the CID voltage is set in consideration of not only the mass-to-charge ratio of the parent ions but also the characteristics of the parent ions, the parent ions can be dissociated more exactly and stably with high efficiency and the dissociated ions can be analyzed with high sensitivity.

Figure 10A:
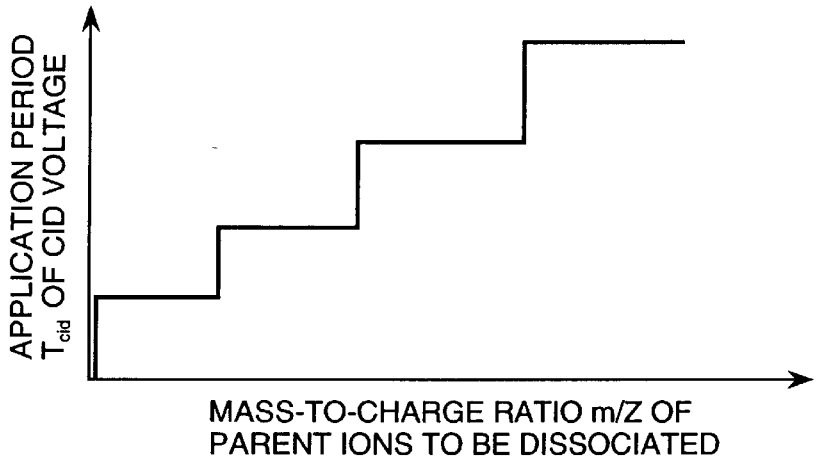
FIGS. 10A–10C illustrate setting methods of an application time of the CID voltage in a third embodiment of the present invention.
Figure 10B:
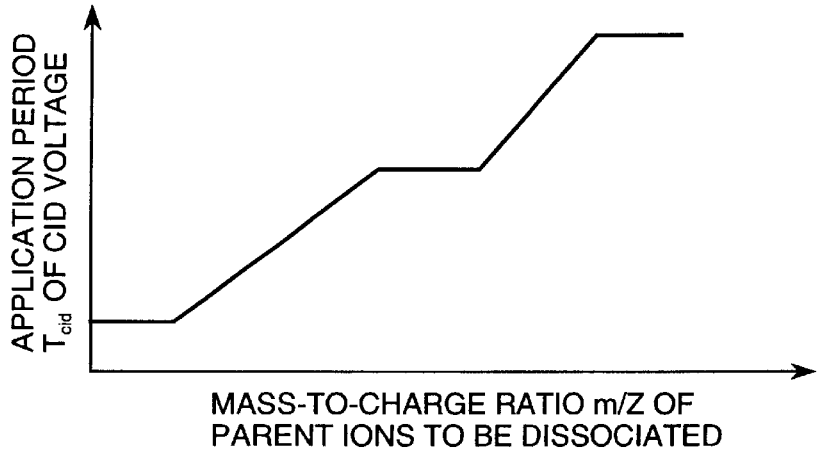
Figure 10C:
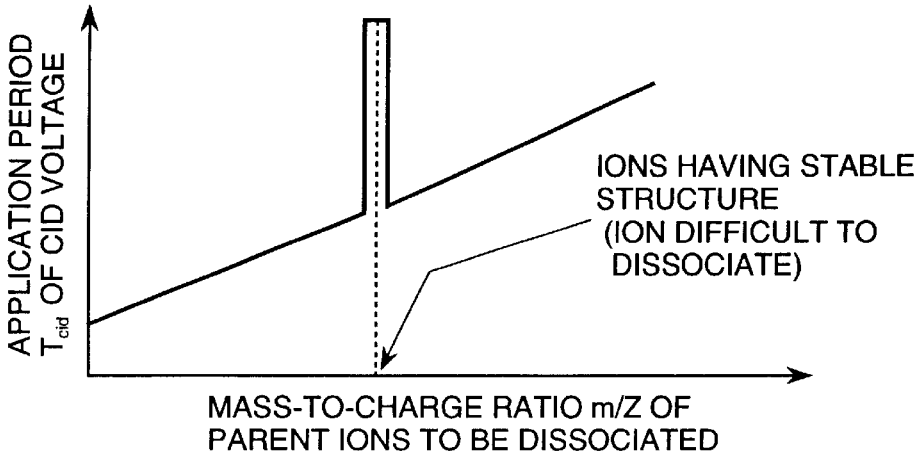

Referring now to FIGS. 10A–10C, a third embodiment of the present invention is described. In this embodiment, when the application period $T_{cid}$ of the CID voltage is changed to be set in accordance with the mass number m (or mass-to-charge ratio m/Z) of the parent ions to be dissociated, the application period $T_{cid}$ may be changed stepwise as shown in FIG. 10A. Alternatively, as shown in FIG. 10B, the application period of the CID voltage may be set on the basis of the combined relation of stepwise change and linear change. In this case, since the relation of the application period $T_{cid}$ of the CID voltage to m is simplified, the application period $T_{cid}$ of the CID voltage can be controlled easily. Further, when the specimen contains a substance which is very difficult to dissociate, the application period $T_{cid}$ of the CID voltage for the ion species difficult to dissociate may be set to be long, especially as shown un FIG. 10C. At this time, since the application period of the CID voltage for the ion species difficult to dissociate is set to be long, such ions are dissociated with high efficiency and the tandem mass spectrometry is performed with high sensitivity.

Figure 11A:
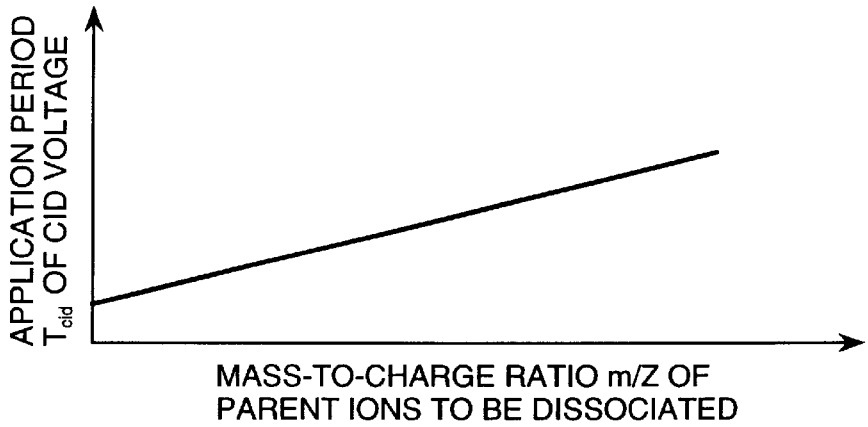
FIGS. 11A and 11B illustrate setting methods of an application time and an amplitude of the CID voltage in a fourth embodiment of the present invention.
Figure 11B:
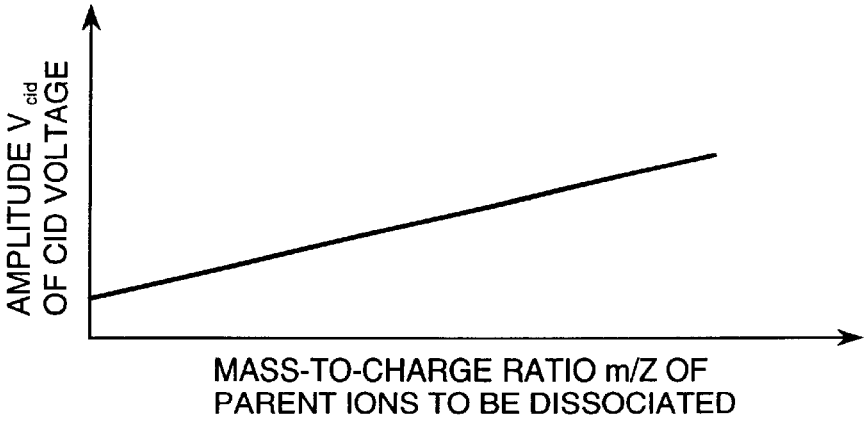

Referring now to FIGS. 11A and 11B, a fourth embodiment of the present invention is described. When the application period $T_{cid}$ of the CID voltage is changed to be set in accordance with the mass number m (or mass-to-charge ratio m/Z) of the parent ions to be dissociated, both of the CID voltage $V_{cid}$ and the application period $T_{cid}$ of the CID voltage may be changed so that the application period $T_{cid}$ is increased in proportion to the mass number m of the parent ions as shown in FIG. 11A and the amplitude $V_{cid}$ of the CID voltage $V_{cid}\cos(2\pi ft)$ is increased in proportion to the mass number m of the parent ions as shown in FIG. 11B. At this time, since the CID voltage is increased in proportion to the mass number m of the parent ions, the effect of improvement of the dissociation efficiency is larger as compared with the case where only the application period of the CID voltage is increased. Accordingly, since the application time of the CID voltage can be set to be short correspondingly, the high-sensitive tandem mass spectrometry can be performed in the reduced analysis time in the embodiment.

Figure 12:
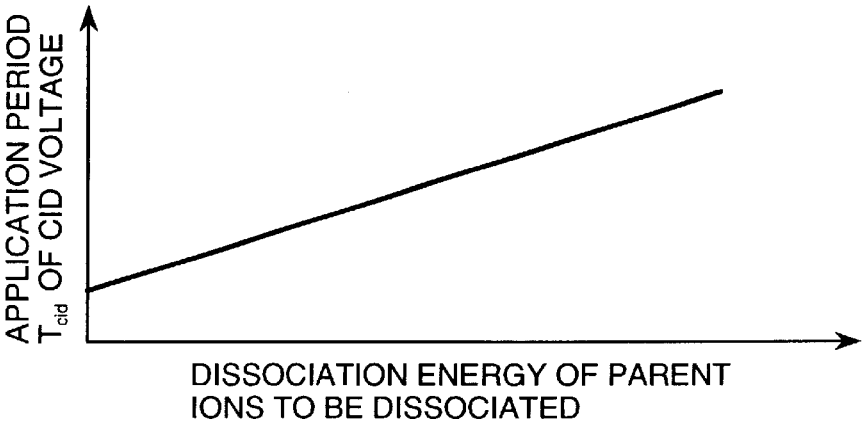
FIG. 12 illustrates setting methods of an application time of the CID voltage in a fifth embodiment of the present invention.

Referring now to FIG. 12, a fifth embodiment of the present invention is described. In this embodiment, as shown in FIG. 12, the application period $T_{cid}$ of the CID voltage is changed to be set in accordance with the dissociation energy of the parent ions to be dissociated. That is, when the dissociation energy of the parent ions is previously understood, the application period $T_{cid}$ of the CID voltage is increased in proportion to the dissociation energy, so that the CID voltage is applied for a long time for the ions requiring a large quantity of energy for dissociation to dissociate the parent ions efficiently. The changing form of the application period $T_{cid}$ of the CID voltage to the dissociation energy of the parent ions at this time may be non-linear change as shown in FIGS. 9A and 9B, stepwise change as shown in FIGS. 10A–10C or simultaneous change of amplitude of the CID voltage as shown in FIGS. 11A and 11B. Thus, according to the embodiment, since the application period of the CID voltage is set to be longer for the parent ions difficult to dissociate, the parent ions can be dissociated exactly and the high-sensitive tandem mass spectrometry can be attained.

Figure 6A:
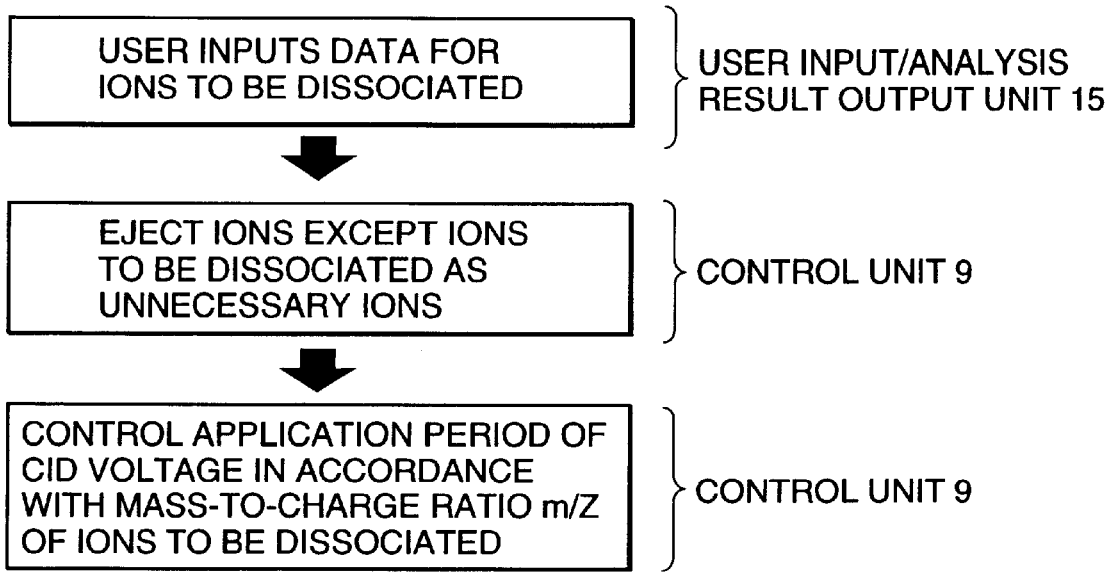
FIGS. 6A and 6B are flow charts of controlling an application time of the CID voltage in the first embodiment of the present invention.
Figure 6B:
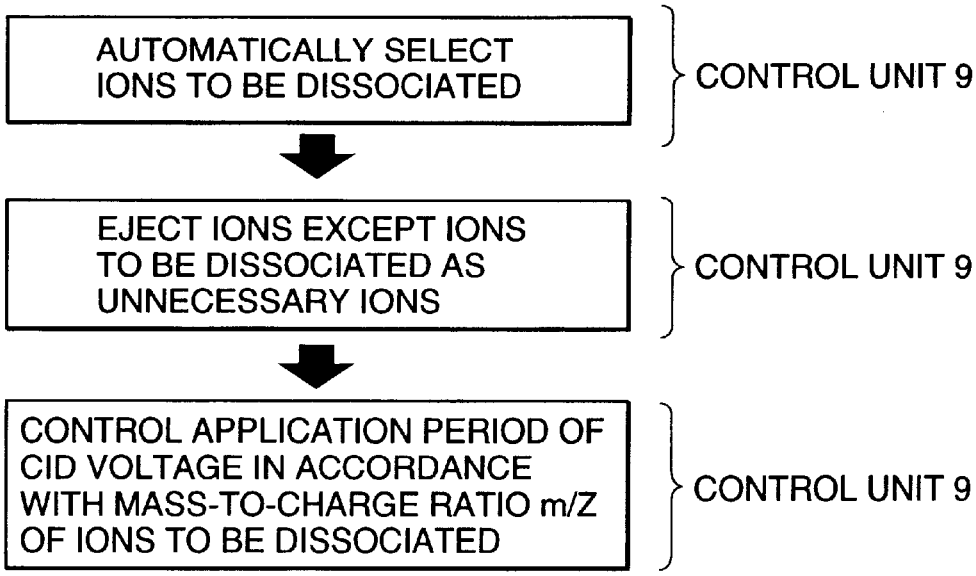
Figure 13A:
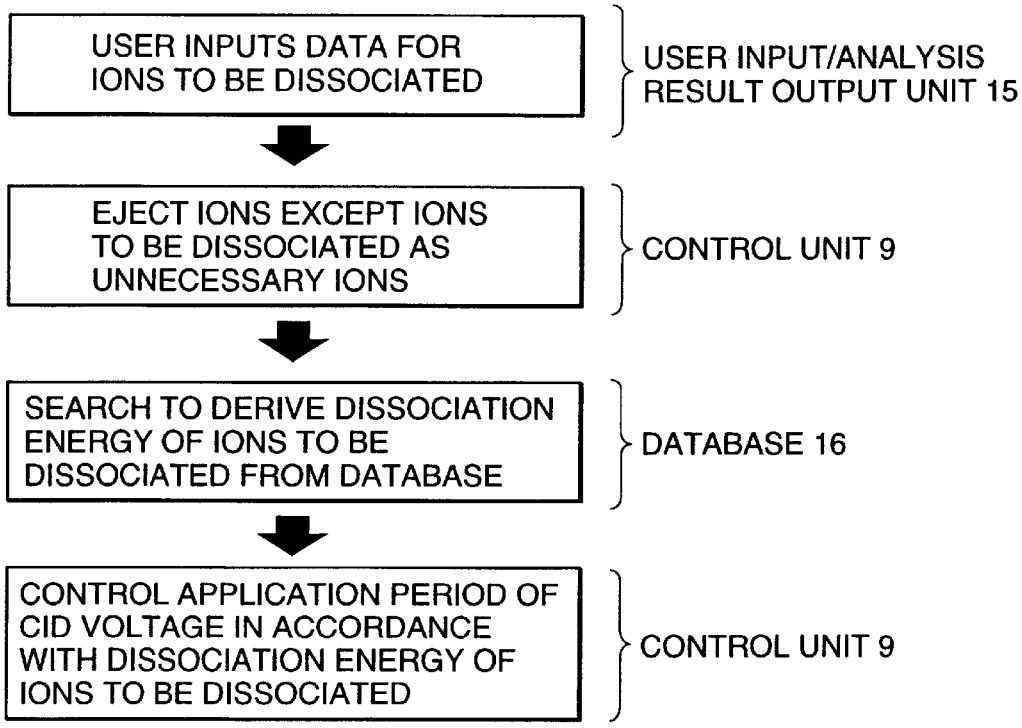
FIGS. 13A and 13B are flow charts of controlling an application time of the CID voltage in a sixth embodiment of the present invention.
Figure 13B:
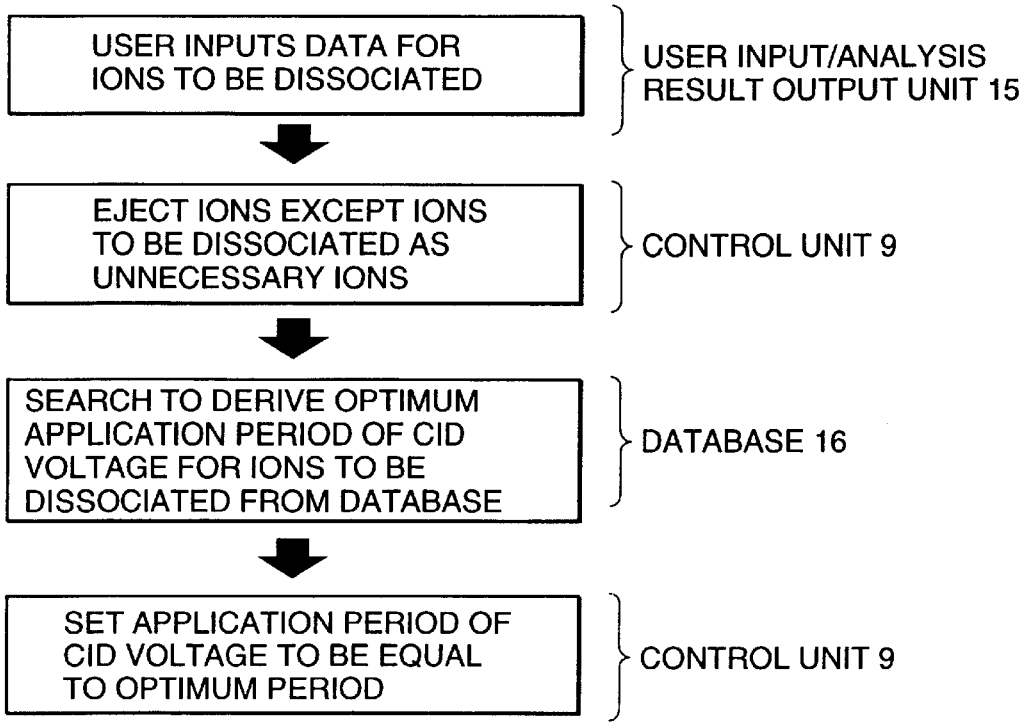

Referring now to FIGS. 1, 13A and 13B, a sixth embodiment of the present invention is described. In this embodiment, the application period $T_{cid}$ of the CID voltage is changed to be set in accordance with data stored in a database 16 shown in FIG. 1. As shown in FIG. 13A, ions except the parent ions to be dissociated are ejected as unnecessary ions by the control unit 9 on the basis of the mass-to-charge ratio m/Z of the parent ions to be dissociated inputted by the user input/analysis result output unit (operation means) 15 and the dissociation energy of the parent ions to be dissociated is searched to be derived from the database 16, so that the application period $T_{cid}$ of the CID voltage is set on the basis of the dissociation energy by the control unit 9. Alternatively, as shown in FIG. 13B, after ions except the parent ions to be dissociated are ejected as unnecessary ions by the control unit 9 on the basis of the mass-to-charge ratio m/Z of the parent ions to be dissociated inputted by the user input/analysis result output unit 15, an optimum application period $T_{cid}^{OPT}$ of the CID voltage of the ions to be dissociated is searched to be derived from the database 16 in which past experiment results are stored and the application period $T_{cid}$ of the CID voltage is set to be equal to the optimum period $T_{cid}^{OPT}$ by the control unit 9. In this connection, selection of the parent ions to be dissociated may be automatically made instead of inputting by the user such that ions having the strongest signal obtained by the pre-scanning operation performed prior to the tandem mass spectrometry are selected as parent ions as shown in FIG. 6B. Thus, according to the embodiment, since the optimum application period $T_{cid}$ of the CID voltage is set for the ionic species to be dissociated on the basis of the characteristics of the ions to be dissociated and the optimum data obtained in the past, it can be expected that the high-sensitive tandem mass spectrometry is performed exactly and stably.

Figure 4B:
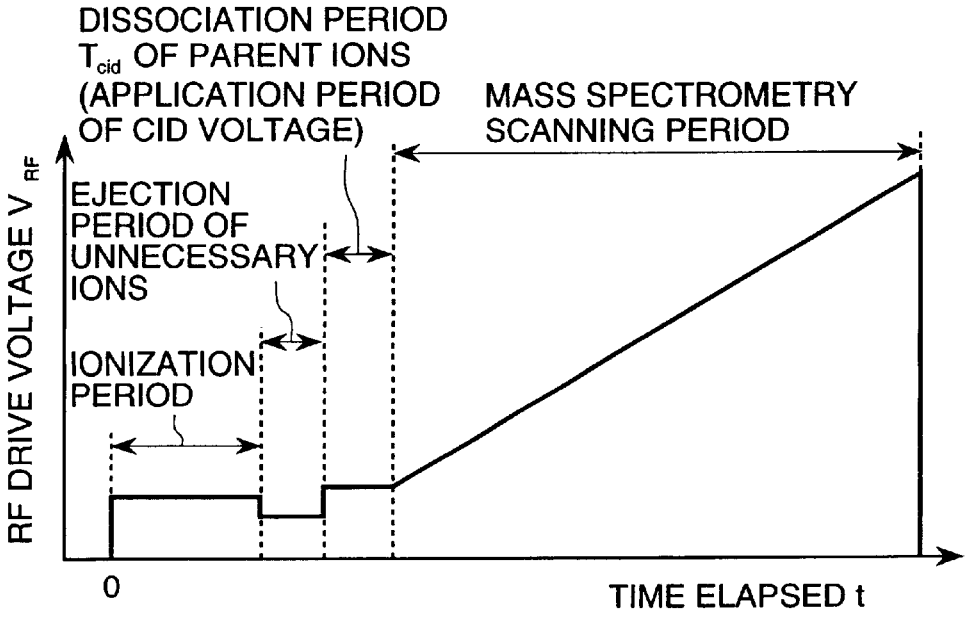
Figure 14:
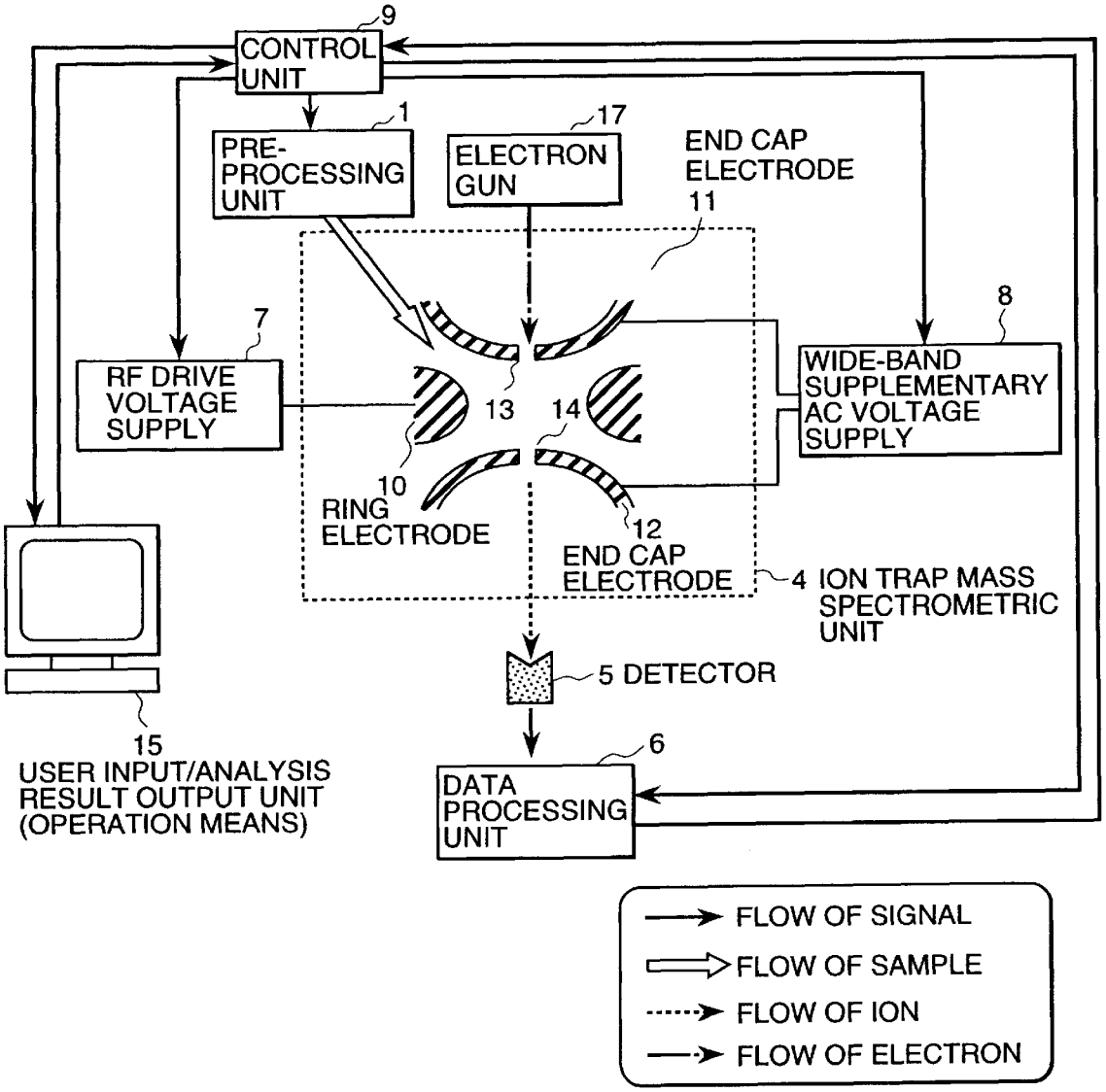
FIG. 14 is a schematic diagram illustrating the whole of an ion trap mass spectrometer according to a seventh embodiment of the present invention.

Referring now to FIGS. 14 and 4B, a seventh embodiment of the present invention is described. FIG. 14 is a schematic diagram illustrating the whole of an ion trap mass spectrometer according to the embodiment. The ion trap mass spectrometer of the embodiment is of the type (internal ionization type) that the specimen in the neutral state injected into the space between the ion trap electrodes is ionized in the space by collision with electrons emitted from an electron gun 17. FIG. 4B is a diagram showing a sequence of tandem mass spectrometric process in the embodiment. A specimen in the neutral state is injected into the space between the ion trap electrodes during the ionization period and ionized by collision with electrons emitted from the electron gun 17. Thereafter, a wide-band supplementary AC voltage is applied during the ejection period of unnecessary ions to eject unnecessary ions and the CID voltage is applied during the dissociation period of the parent ions to dissociate the parent ions. In this connection, as shown in FIG. 4B, the amplitude $V_{RF}$ of the RF drive voltage $V_{RF}$ cos $\Omega t$ applied to the ring electrode may be set to be different during the respective periods including the ion injection period, the ejection period of unnecessary ions and the dissociation period of parent ions. In this embodiment, similarly, after ions except the parent ions are ejected as unnecessary ions by the control unit 9 on the basis of the mass-to-charge ratio m/Z of the parent ions to be dissociated inputted by the user input/analysis result output unit (operation means) 15, the application period $T_{cid}$ of the CID voltage is set in accordance with the parent ionic species (mass-to-charge ratio m/Z of parent ions). Accordingly, the embodiment can be applied to the ion trap mass spectrometer of the ionization type of electron impact and similarly the high-sensitive tandem mass spectrometry can be attained.

According to the embodiments described above, when the specific ionic species in the specimen is subjected to tandem mass spectrometry, the application period of the supplementary AC voltage applied in superposition manner in order to dissociate the specific ionic species in accordance with the mass-to-charge ratio or characteristics of ions to be dissociated is optimized to thereby dissociate the ions to be dissociated efficiently so that high-sensitive analysis of dissociated ions can be attained. Further, since the application period of the supplementary AC voltage applied in superposition manner in order to dissociate the specific ionic species can be optimized automatically, handling of the apparatus can be also improved.

According to the present invention, the ions to be dissociated can be dissociated efficiently and the high-sensitive analysis of the dissociated ions can be attained in a short time.

It should be further understood by those skilled in the art that the foregoing description has been made on embodiments of the invention and that various changes and modifications may be made in the invention without departing from the spirit of the invention and the scope of the appended claims.

What is claimed is:

1. An ion trap mass spectrometer including an ion source for generating ions, ion trap electrodes forming an inter-electrode space for capturing the ions, means for generating a supplementary AC electric field having a specific frequency in said inter-electrode space and means for detecting ions ejected from said inter-electrode space; comprising means for changing an application period of said supplementary AC electric field having said specific frequency in accordance with an ionic species to be dissociated.

2. An ion trap mass spectrometer according to claim 1, comprising means for making said application period of said supplementary AC electric field having said specific frequency longer as a mass-to-charge ratio of said ions to be dissociated is larger.

3. An ion trap mass spectrometer according to claim 1, comprising means for lengthening said application period of said supplementary AC electric field having said specific frequency in proportion to a mass-to-charge ratio of said ions to be dissociated.

4. An ion trap mass spectrometer according to claim 1, comprising means for making said application period of said supplementary AC electric field having said specific frequency longer as dissociation energy of said ions to be dissociated is larger.

5. An ion trap mass spectrometer according to claim 1, comprising means for changing a magnitude of said supplementary AC electric field in accordance with said ionic species to be dissociated.

6. An ion trap mass spectrometer according to claim 5, comprising means for making said supplementary AC electric field having said specific frequency larger as a specific mass-to-charge ratio of said ions to be dissociated is larger.

7. An ion trap mass spectrometer including a ring electrode, two end cap electrodes disposed opposite to each other so that said ring electrode is disposed between said two end cap electrodes, a radio-frequency power supply for generating a radio-frequency voltage supplied across said ring electrode and said end cap electrodes, an ion source for generating ions, means for capturing said generated ions in an inter-electrode space in which a radio-frequency electric field is generated, means for generating a supplementary AC electric field having a certain specific frequency in said inter-electrode space, and means for detecting ions ejected from said inter-electrode space; comprising means for changing an application period of said supplementary AC electric field having said specific frequency applied in order to resonantly excite ions having a specific mass-to-charge ratio in accordance with ionic species to be dissociated.

8. An ion trap mass spectrometer according to claim 7, comprising means for making said application period of said supplementary AC electric field having said specific frequency longer as the mass-to-charge ratio of said ions to be dissociated is larger.

9. An ion trap mass spectrometer according to claim 7, comprising means for lengthening said application period of said supplementary AC electric field having said specific frequency in proportion to the mass-to-charge ratio of said ions to be dissociated.

10. An ion trap mass spectrometer according to claim 7, comprising means for making said application period of said supplementary AC electric field having said specific frequency longer as the dissociation energy of said ions to be dissociated is larger.

11. An ion trap mass spectrometer according to claim 7, comprising means for changing a magnitude of said supplementary AC electric field in accordance with said ionic species to be dissociated.

12. An ion trap mass spectrometer according to claim 11, comprising means for making said supplementary AC electric field having said specific frequency larger as the specific mass-to-charge ratio of said ions to be dissociated is larger.

13. An ion trap mass spectrometer including an ion source for generating ions, ion trap electrodes forming an inter-electrode space for capturing the ions, means for generating a supplementary AC electric field having a specific frequency in said inter-electrode space and means for detecting ions ejected from said inter-electrode space; comprising operation means for enabling a user to input an application period of said supplementary AC electric field having said specific frequency and setting it said application period.

14. An ion trap mass spectrometer according to claim 13, wherein said operation means includes means for enabling the user to input ionic species to be dissociated, a mass-to-charge ratio of ions to be dissociated or dissociation energy and said ion trap mass spectrometer further comprising means for changing over said application period of said supplementary AC electric field having said specific frequency on the basis of said inputted information.

15. A method of ion trap mass spectrometry including a step of generating ions by an ion source, a step of capturing the ions in an inter-electrode space formed by ion trap electrodes, a step of generating a supplementary AC electric field having a specific frequency in said inter-electrode space, and a step of detecting ions ejected from said inter-electrode space; comprising a step of changing an application period of said supplementary AC electric field having said specific frequency in accordance with ionic species to be dissociated.

* * * * *